US005362055A

United States Patent [19]

Rennie

[11] Patent Number: 5,362,055

[45] Date of Patent: Nov. 8, 1994

[54] HOLLOW HAVING PLATE WELDED IN CROWN AND STRIKING FACE INSERT METAL WOOD

[75] Inventor: Gordon S. Rennie, Humble, Tex.

[73] Assignee: Progear, Inc., Houston, Tex.

[21] Appl. No.: 88,917

[22] Filed: Jul. 8, 1993

Related U.S. Application Data

[63] Continuation of Ser. No. 849,735, Mar. 12, 1992, abandoned.

[51] Int. Cl.[5] ..... A63B 53/04

[52] U.S. Cl. ..... 273/167 H; 273/173; 273/167 J

[58] Field of Search ..... 273/167 R, 173, 167 G, 273/167 H, 167 J, 167 K, 78, 171

[56] References Cited

U.S. PATENT DOCUMENTS

| | | | |
|---|---|---|---|
| D. 318,087 | 7/1991 | Helmstetter | D21/214 |
| 1,840,451 | 1/1932 | Jansky | 273/173 |
| 2,026,749 | 1/1936 | Pester | 273/173 |
| 3,390,881 | 7/1968 | Senne | 273/167 R |
| 4,367,878 | 1/1983 | Schmidt | 273/175 |
| 4,417,731 | 11/1983 | Yamada | 273/167 H |
| 4,471,961 | 9/1984 | Masghati et al. | 273/175 |
| 4,681,322 | 7/1987 | Straza et al. | 273/173 |
| 4,762,322 | 8/1988 | Molitor et al. | 273/77 |
| 4,838,555 | 6/1989 | Kobayashi | 273/167 |
| 5,004,241 | 4/1991 | Antonious | 273/167 |
| 5,042,806 | 8/1991 | Helmstetter | 273/80.2 |
| 5,180,166 | 1/1993 | Schmidt et al. | 273/167 H |

FOREIGN PATENT DOCUMENTS

| | | | |
|---|---|---|---|
| 405049716 | 3/1993 | Japan | 273/167 G |
| 2225725 | 6/1990 | United Kingdom | 273/167 H |

*Primary Examiner*—Vincent Millin
*Assistant Examiner*—William M. Pierce
*Attorney, Agent, or Firm*—Arnold, White & Durkee

[57] ABSTRACT

An oversized metal wood golf club head having a ball striking face, a bottom sole portion and a upper portion or crown. The club head is molded or formed in substantially one piece, the crown having an opening which is sealed by securing a crown plate in the opening. The metal wood has a nonmetallic insert secured to a cavity formed in the ball striking face and reinforced by ribs on the interior of the face and the walls of a cavity formed in the club striking face. The insert is secured in the cavity by adhesion which is enhanced by channels formed in the insert cavity and hollow columns formed in the insert.

18 Claims, 5 Drawing Sheets

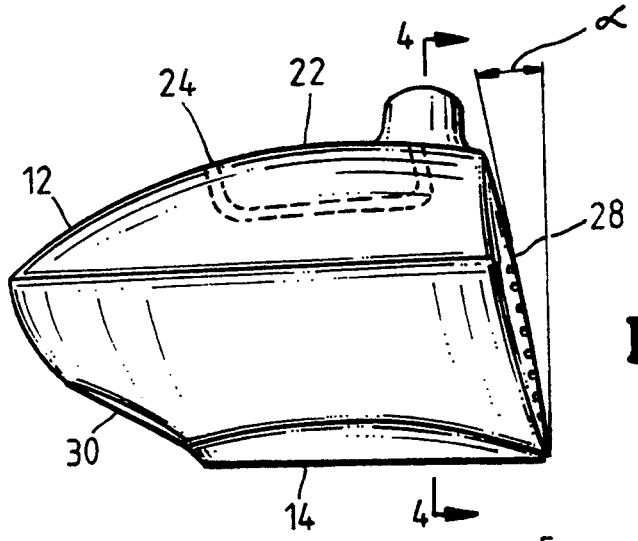
Fig. 2
Fig. 3A
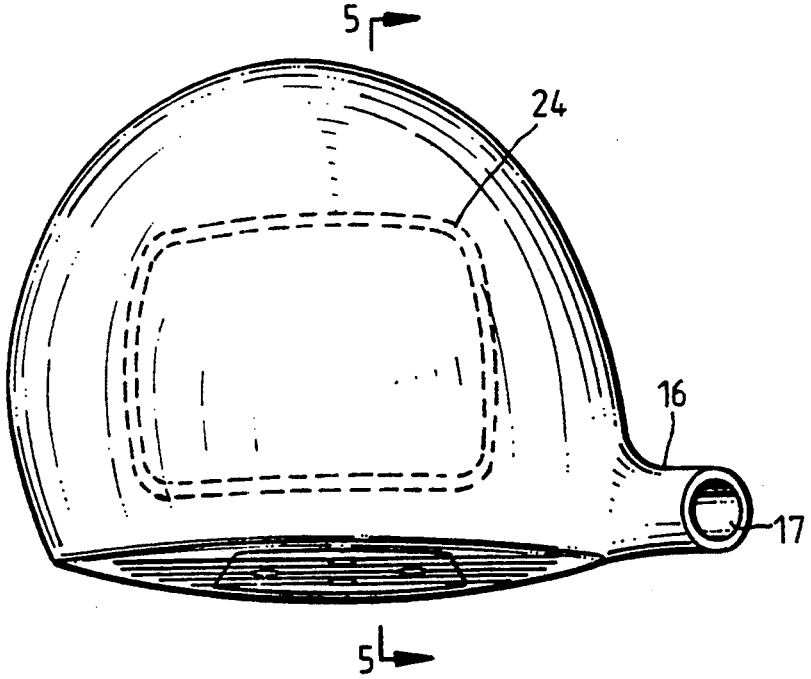
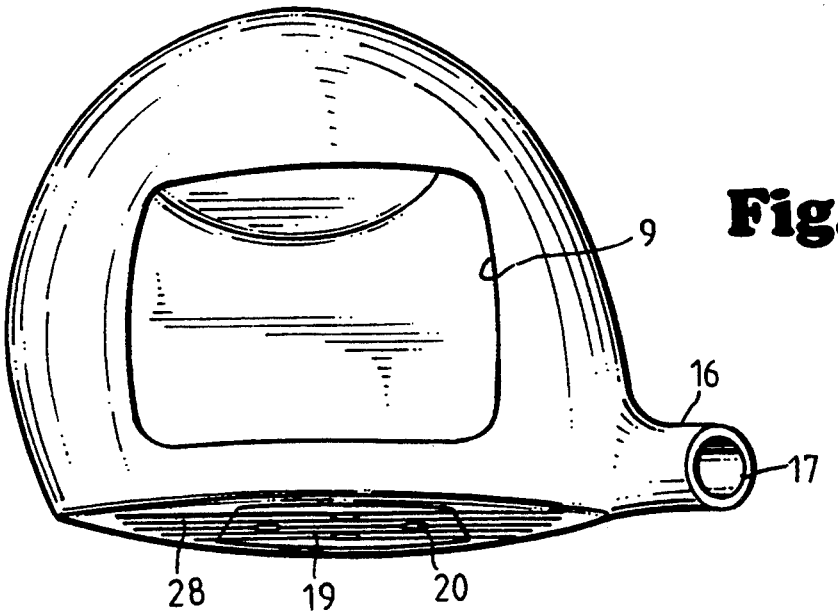
Fig. 3B

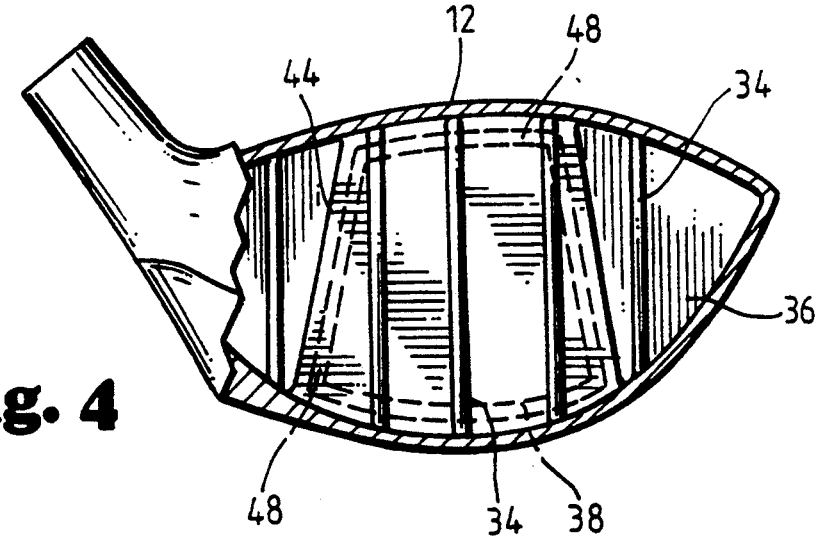
Fig. 4
Fig. 5
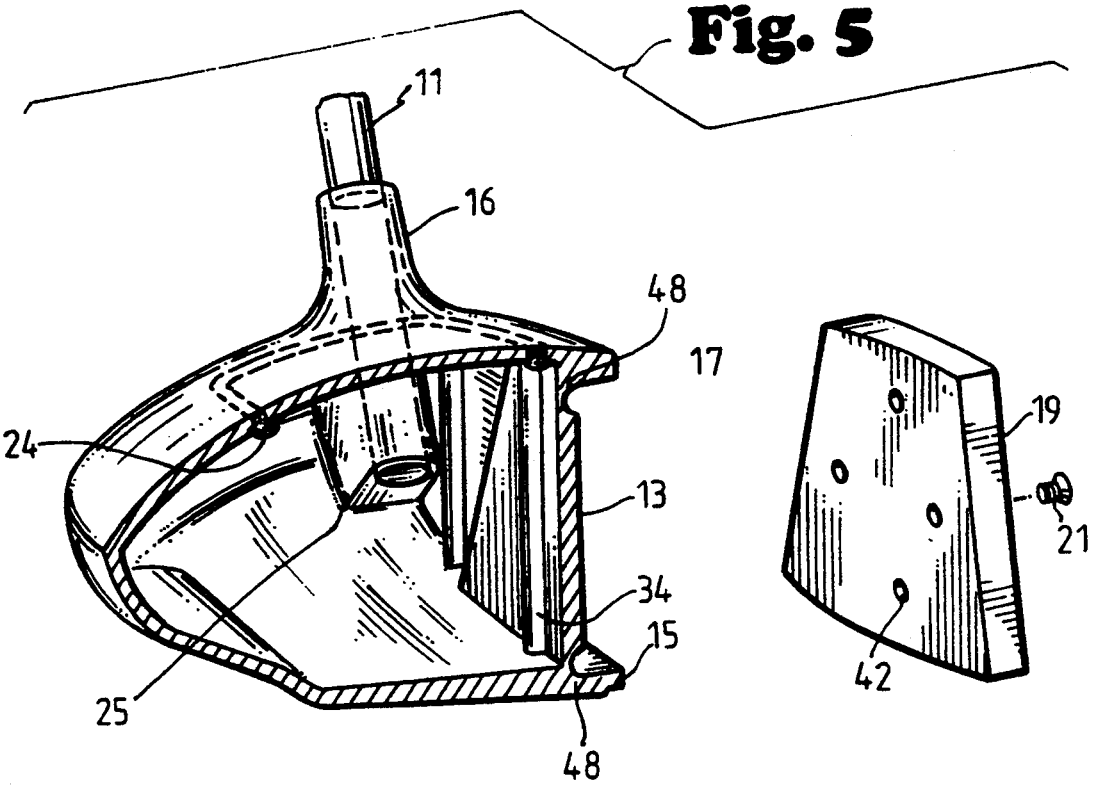

HOLLOW HAVING PLATE WELDED IN CROWN AND STRIKING FACE INSERT METAL WOOD

This application is a continuation of application Ser. No. 07/849,735, filed on Mar. 12, 1992 now abandoned.

BACKGROUND OF THE INVENTION

This invention relates to the field of golf clubs. More specifically, it relates to a metal wood club with an improved club head.

The desire to improve one's golf game and increasing the player's competitive advantage have led to many improvements in the design of golf clubs over the years. A relatively recent development is that of the "metal wood". Traditionally, woods (clubs usually used for tee shots and longer fairway shots) have had heads made of hard wood, the preferred wood being persimmon. The tendency of wood to warp or split, however, coupled with increasing cost of material and labor, has led to the development of metal heads for the woods. Such metal woods typically comprise a hollow cast metal shell filled with a synthetic plastic foam material.

The metal wood has achieved a large measure of success in terms of acceptance in use by skilled golfers. Nevertheless, many golfers still prefer traditional, "wooden" woods, because of what they consider to be non-optimal weight distribution in metal wood heads. Specifically, a very important element of the club head design is the concentration of as much of the mass of the head as possible into the face of the club head in the portion of the head behind the face. This puts the mass of the head where it effectively contributes to energy imparted to the ball, rather than being merely "dead weight" that limits the velocity of the club head when it is swung. In other words, such a distribution of the mass in the club head increases the effective mass of the head, without increasing this total mass. Maximizing the effective mass of the head without significantly increasing its total mass results in a little or no loss in the achievable club head velocity. The result is greater shot distance, since the energy imparted to the ball by the club is proportional to the effective mass of the club head times the square of the club head velocity. Preferably the mass in the club head is distributed around the perimeter of the club face. Perimeter weighting gives the club a larger sweet spot. Thus the perimeter weighed club is more forgiving. That is, a golfer need not strike the ball in the center of the club face to project the ball in a straight path. The enlarged sweet spot of a perimeter weighted club face allows the golfer a larger margin of error when striking the ball. A hit off-center still achieves a straight shot.

Recently, metal woods have become larger and oversized metal woods are now very popular. It is desirable to maximize the size of the oversize club head without increasing the weight of the club head to achieve maximum distance and velocity. In producing an larger oversized metal club head, therefore, the walls of the club head are thinner than a normal size club to avoid increasing the weight of the larger club and reducing the swing velocity. The enlarged or oversized metal wood heads are therefore thinner than conventional clubs and thus more susceptible to failure by cracking or crushing.

The top of the metal club head or crown in some oversized heads, is so thin that a golfer may crush or crack the metal club head by stepping on the crown.

Some manufacturers of oversized clubs will not warrant against these types of failures. The metal club head is also subject to failure at the crown by cracking or crushing by allowing the crown to strike the sole of another club when inserting the oversized metal club head into the golf bag.

Another disadvantage of conventional metal woods and oversized metal woods is crystallization of the head packing material causing the club head to rattle. The shaft penetrates the hollow metal club head and transmits vibrational energy to the packing material adjacent the shaft. This vibrational energy can crystallize the packing material. Crystallized packing material hardens and separates, causing a distracting rattle inside the club head.

Another disadvantage of conventional metal wood club heads is that they are molded or cast with an opening in the bottom or sole portion of the club head. A sole plate is welded over the opening to seal the club head. The sole plate welding seam creates a structural discontinuity at the juncture of the front edge of the sole plate and bottom edge of the face plate. This structural discontinuity or weld seam may be subject to failure as the face strikes the ball or the sole strikes the ground. The weld also increases the weight of the bottom portion or sole of the club. The increased weight and metal in the sole means that weight and less metal may be placed in the crown. The crown must, therefore, be thinner and more susceptible to the crushing or cracking by forces acting normal to the crown surface.

Another disadvantage of oversized metal wood club heads is that the ball striking face on these clubs is thinner due to the weight restriction, therefore, susceptible to structural failure by crushing or deformation when striking a ball. Increasing the mass of the club face by increasing the thickness of the face results in a rigid club face and the undesirable effect of a limiting the sweet spot. A thinner face is more flexible. Moreover, a thin club face with perimeter weighting achieves a larger sweet spot. Also there is a weight limit on the amount of metal a design can allocate to the club face without increasing the overall weight of the club head and reducing the club head velocity.

SUMMARY OF THE INVENTION

The present invention is a "metal wood" golf club head to which a shaft is attached. More specifically, the golf club head of the present invention comprises an upper metal surface (the crown), a front ball striking surface (the face) which extends from the heel to the toe of the club head and is comprised of a metallic wall (the face wall) containing a centrally located sunken cavity (the insert cavity) into which a non-metal insert (the insert) is secured. The exterior ball-striking face of the club head is comprised of two horizontally-grooved metal surfaces (the metal face) adjacent, flush with and flanking the similarly grooved non-metallic insert. The golf club head is also comprised of a lower metal surface or sole portion comprised of three distinct surfaces or contours: (1) the front portion of the sole which extends from the lower edge of the face backwards along the sole to the convex portion of the sole, (2) the rear portion of the sole which extends forward from the rear junction of the sole and crown to its junction with the convex portion of the sole and (3) a convex surface located between the front and rear portions of the sole surface.

The hosel is located on the crown near the heel end of the club head. The golf club shaft is attached to the club head by penetrating the head through a circular opening in the center of the hosel. The hosel assembly continues into the interior of the club head to depth equal to the shaft's penetration into the club head. The hosel continuation may continue to a variable depth until it almost contacts the interior surface of the sole. Clearance between the hosel continuation and the sole is allowed to facilitate flow of packing material that is injected into the head through the hosel bore.

The continuation of the hosel assembly insulates the shaft so that it does not directly contact the packing material inside the club head. The hosel assembly thus insulates and reduces vibrational energy transmitted from the shaft to the packing material and reduces crystallization of the packing material. This helps overcome one source contributing to the problem of the distracting rattle.

The insert cavity helps to distribute the mass of the club face around the perimeter of the club face. Perimeter weighting helps develop the striking surface face with a larger sweet spot. The insert cavity is formed by walls formed in the club face wall. The walls of the insert cavity may be thicker or thinner than the club face wall. The insert cavity walls project rearwardly and perpendicular to the plane of the club face wall. These walls support the club face as well as adding mass to it. The walls thus allow for a strong club face with a reduced amount of mass or metal, thus achieving increased potential club head swing velocity.

The interior surface of the club face wall is also reinforced with vertical ribs. These ribs are formed on the interior surface of the club face wall. The ribs act to support and strengthen the club face wall. The ribs reinforce the front face allowing it to be thin and flexible yet have the structural strength of a thicker striking surface.

The invention is further characterized by a crown plate. The face, sole and crown portions of the oversize metal wood head are cast in a single piece so that there are no welding or securing seams in the sole or the club face. Instead, an opening is formed in the crown where a crown plate is installed. The seam formed by welding or securing the crown plate in the crown reinforces the crown and overcomes the problems of structural failures or crumpling of the thinner crowns found in oversize club heads that do not contain a crown seam. The welding of the crown plate into the opening in the crown of the club body results in significant strengthening of the crown and the top of the face that adjoins the crown. Moreover, the face wall also has additional strength because the crown plate weld or securing seam functions as a reinforcing rib supporting the crown and therefore top of the face that adjoins the crown.

The crown is effectively divided into three smaller sections by the crown plate seam and is therefore stronger and overall less flexible than a similar crown without a seam. The reinforced crown with a seam is less susceptible to crushing. Moreover, strengthened crown require less metal to support the crown. Metal that would otherwise be employed in thickening and strengthening the crown may be utilized in strengthening and adding mass to the club face or sole of the club head without increasing the overall weight of the club. The club head of the present invention is thus stronger than a club of the same weight, volume and material made without a crown seam.

The club face is also supported by the presence of internal ribs located on the interior surface of the club face. The support ribs are rounded in shape to enhance uniform distribution or flow of the interior packing material injected into the club head. This helps to eliminate or reduce the formation of air pockets near the interior surface of the face adjacent the ribs. Air pockets reduce the support to the face offered by the packing material. Also, the insert cavity walls serve to significantly strengthen the central striking area of the club face. The cavity walls serve to effectively strengthen and thicken the club face at the point of impact. The insert walls protrude at right angles or perpendicular to the striking surface face wall of the face and "in line" with the most probable forces that will act upon the face of the club head upon striking the golf ball. Moreover, the cavity walls also serve to reduce the length of the span between ribs or alternatively the need to increase the number of reinforcing ribs and overall weight of the club head.

The insert cavity employs an nonmetallic insert to form a smooth exterior striking surface on the face wall. In a preferred embodiment the insert is made of Cycolac or Acrylonitrile Batadiene Styrene Terpolymer ("ABS"), but may be any material. The design of the insert and the cavity itself utilize channels and columns enhance adhesion of the insert to the insert cavity surface and thus anchor the insert into the cavity and insure its retention in the face wall. The design of the cavity employs sunken or notched channels or grooves along the perimeter of the insert cavity surface at the conjunction of the insert cavity surface and the insert cavity walls. These channels act as an adhesive anchor into which liquid epoxy or cement, used to affix the insert within the cavity, may flow. These channels enhance securing the insert to the insert cavity surface.

The channels may include a small cross-hatching or irregular patterns to enhance the adhesive effects of the epoxy. The exterior surface of the cavity surface may also be of a non-smooth, roughened nature, enhancing bonding or adhesion of the epoxy to the cavity surface. The back of the insert is similarly roughened or grooved. Cavities or holes may be formed in the back of the insert to enhance bonding or adhesion of the epoxy to the insert in the cavity.

The insert itself is principally composed of non-metallic materials (other than the pins as hereinafter described) and is formed and inserted separately into the insert cavity after completion of construction of the exterior metal portions of the club head and after affixing the crown plate to the body of the club head. The insert is retained in the insert cavity through the application of a liquid epoxy or other bonding agent or substance on the surfaces of the insert, insert cavity surface and insert cavity walls.

The insert includes four (4) hollow metallic pins (the "face pins"), which are knurled, grooved or otherwise constructed along the exterior surfaces of their length so as to provide better bonding and attachment between the exterior of such pins and the insert. The pins are placed at right angles to, and flush with, the exterior surface of the insert and extend from the exterior surface of the front face of the insert, through the insert, to end flush with and recessed from the proposed interior or back surface of the insert. The pins are inserted into the insert at the time that the insert is constructed so that the pins form an integral part of the insert after its construction. The pins are closed at that end (the "head") appearing flush with the exterior or front face of the insert and are hollow or open at the other end of the pins so that, at the time of installing the insert in the insert cavity, epoxy in the cavity may flow into the hollow pins, thus better securing the insert to the insert cavity.

The Pins are positioned in the insert in a spaced vertical diamond pattern centrally located on the face of the insert.

After completion of construction of the club head, the closed end of each face pin is visible from the exterior surface of the insert or face and when so viewed, appears as a smooth rivet head or conventional attachment screw which has been counter-sunk flush to the exterior face surface of the insert.

These hollow pins form open ended air columns that permit the epoxy or bonding agent to flow into these interior of the open ended pin holes or columns. This results in better anchoring of the insert to the insert cavity surface as epoxy flows into the hollow pins. The amount of air left in the open-ended hollow pin column may be controlled by the amount of epoxy placed in the cavity which determines the amount of epoxy flowing into the pin column. The amount of air left in the pin hole column and pin affects the sound and feel of the club. The amount of air in the columns also changes the flexibility of the club face and its feel and effect on the ball.

The face wall, the sole and a posterior portion of the crown are cast and formed ("single unit construction") as one piece (the "club head body"). The casting process employed results in the completion of the construction of all perimeter metal surfaces of the club head with the exception of an opening in the crown which may commence at and along the upper edge of the metal face wall and proceeds backwards to the anterior edge of the partially completed crown. The metal exterior of the club head body is completed and the aforementioned opening is "closed in" by welding a separately cast metal piece (the "crown plate") to the club head body along the top edge of the metal face wall and the edges of the incomplete crown.

The hosel is formed as an integral part of the body wall and extends through the wall of the body as an open-ended metal cylinder into the interior body cavity (the "hosel extension").

BRIEF DESCRIPTION OF THE DRAWINGS

FIG. 2 is a front elevation view of the golf club shown in FIG. 1.

FIG. 3 is a top view of the golf club shown in FIG. 1.

FIG. 4 is a plan view of the interior surface of the front face of the golf club showing the support ribs and cavity walls.

FIG. 5 is a front cross-sectional view taken along line 5—5 in FIG. 3 showing the extended hosel penetrating the interior of the club head.

DETAILED DESCRIPTION OF PREFERRED EMBODIMENT

Figure 1A:
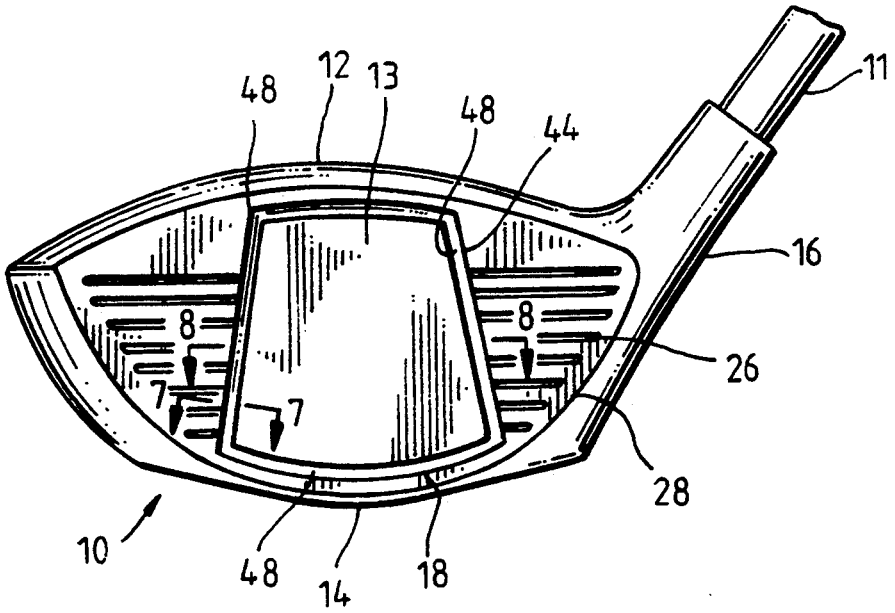
FIG. 1 is a front elevation view of a metal wood golf club in accordance with a preferred embodiment of the present invention, showing the head and lower portion of the shaft.

Referring to the drawings, a golf club head 10 in accordance with a preferred embodiment of the present is shown in FIG. 1. FIG. 1A shows the golf club head 10 with a shaft 11 attached to the club head 10 by inserting the shaft 11 into hosel 16 so that the shaft penetrates the interior of the club head 10. The club head 10 as shown in FIG. 1 comprises a hollow metal shell which is filled with a foam or packing crystals. In a preferred embodiment the metal head is filled with expandable crystals which may be weighted precisely to account for variances in the overall weight of the molded head piece 10. This technique reduces the number of heads that must be rejected due to weight variances. In a preferred embodiment the club head weighs between 195 and 205 grams.

The club head 10 is comprised of a crown 12, a sole 14 and a club face 28. The club face 28 is scored, etched or molded to form horizontal face grooves 26. The club face also includes an insert cavity 18. The rear exterior surface of the insert cavity be contains channels 48 at the perimeter of the straight or semi-vertical edges of the insert cavity be walls.

Figure 1B:
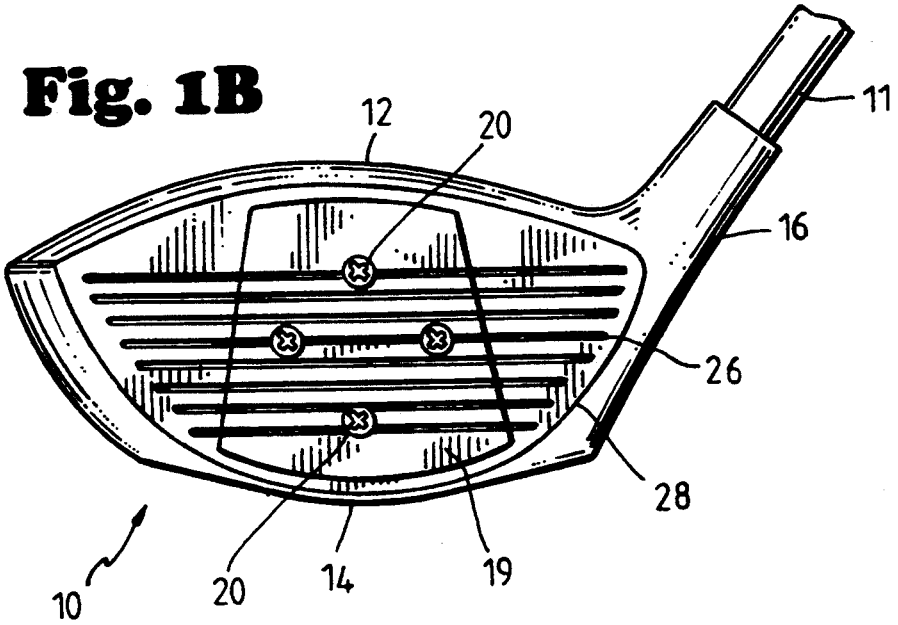

Referring now to FIG. 1B an insert 19 is secured to the insert be with an epoxy, cement or some other adhesive. The insert 19 may also be secured within insert cavity be by pressure or a molding process. Face pins 20 are arranged in a diamond pattern or other pattern in the insert and can be seen on the exterior face of the insert 18. The face pins 20 are hollow so that epoxy or adhesive may flow into the hollow interior of the face pins 20 through face pin holes 42 shown in FIG. 5. The combination of channels 48 and face pin holes 42 and hollow face pins 20 allows conventional epoxy or adhesive to flow into the empty spaces and enhance adhesion of the epoxy or adhesive to the insert cavity surface 13 and to the insert 19. Enhanced adhesion helps secure the insert 19 to the insert cavity surface 13 exterior.

Referring now to FIG. 2, in a preferred embodiment the club head 10 is cast in a single piece forming a club face 28, a sole 14, a crown 12 with a opening formed in the crown. This opening is filled by a crown plate 22. The crown plate 22 is secured to crown 12 by welding, adhesion, pressure, molding or some other process. In a preferred embodiment the crown plate 22 is welded to crown 12 to fill the opening 9 in the crown 12. This welding or securing by other means forms reinforcing a seam 24 in the crown at the juncture of the crown plate 22 with the crown 12. In a preferred embodiment the opening 9 formed in the crown 12 may have an angle or lip formed at its edge so that the crown plate 22 fits into the opening and engages the angle or lip of the opening 9 in a complimentary fashion to support the crown plate 22. The crown plate 22 thus engages the crown opening 11 so that the crown plate 22 does not fall into interior of the club head. The crown plate 22 then stays in place to facilitate welding or securing of the crown plate 22 to the crown opening 9 in the crown 12. A top view of the crown plate 22 secured in the crown 12 is shown in FIG. 3A. The double dashed line 24 in FIG. 3A shows the location of the seam. A top view of the crown 12 and opening 9 in the crown is shown in FIG. 3B.

The rear portion of the sole 14 at the end opposite the face adjoins a concave surface 30. This concave aerodynamic surface 30 reduces the turbulence generated by the club head 10 as it passes through the air during the golf swing. The concave surface 30 reduces the aerodynamic drag of the club head 10 as it passes through the air and also reduces the amount of lift generated by air passing swiftly over the convex crown 12 of the club head. The reduction of lift and drag helps maintain the loft angle of the club head shown by the angle alpha in FIG. 2. The aerodynamic forces exerted on the club head can cause the club head to deflect. This deflection increases the deflection angle alpha and increases the loft of the club. This increase is an undesirable as it reduces the distance the ball travels because energy is wasted by projecting the ball in a higher trajectory than desired.

In a preferred embodiment a crown plate 22 is located centrally in the crown 12 as shown in FIG. 3B. However, the location of the opening 9 in the crown 12 and the location of the crown plate 22 that fills the opening may vary. The location and shape of the opening 9 and crown plate 22 may be adjusted to any configuration or location on the crown 12.

Referring to FIG. 4, the support ribs 34 are shown. Support ribs 34 are formed on the interior surface 36 of the club face 28. These ribs may be either square, triangular, rounded or any other shape. In a preferred embodiment the ribs are triangular in shape with a rounded edge at the apex of the triangular shape with its base adjacent the interior face wall surface to enhance the flow of packing material while increasing the strength and reducing the with the minimum amount of metal or mass. The walls 44 of the insert cavity are shown in FIG. 4. The walls 44 of the insert cavity 18 form a sunken box on the club face 28 to hold the insert 9. In a preferred embodiment the walls 44 are a uniform thickness on all four sides to enhance quality control during molding process and heat treatment. The thickness of the insert cavity walls also affects the sound and feel of the club when striking a golf ball with the insert 19. The insert cavity walls also serve to support and strengthen the club face.

In a preferred embodiment the club head shell is formed of a titanium-aluminum alloy preferably 92% aluminum and 8% titanium. This alloy composition may vary. The molded club head is heat treated to enhance the sound and feel of the club when striking a golf ball. Heat also hardens the club head. The ball striking surface face wall [exclusive of the support ribs 34] and each of the insert cavity walls are generally of uniform thickness. Uniform thickness enhances the sound and feel of the club head when striking a ball. Heat treatment also affects the sound and feel of the golf club when the striking the golf ball. Heat treating gives club a lower, more natural and pleasing sound and feel when striking a golf ball. The club feels and sounds more like a wooden golf club and less like a metal golf club.

In a preferred embodiment the insert is made of Cycolac or ABS resin. These materials are commonly known and used for inserts in the golf industry. Cycolac inserts are available from cell parts. ABS resin is available from scotch weld. Cycolac is the material traditionally used as a face insert in persimmon or wooden golf clubs. Cycolac inserts are available from Cell Parts Mfg. Co., 5220 N. Rose Ave., Rosemont, Ill. 60018, telephone (708) 678-2590. ABS is available from Scotch Weld, General Electric Plastics Division, 9709 Burleson, Dallas, Tex. 75243. Therefore, in the present invention the golfer has a striking surface or insert similar to the traditional wooden club with the advantages of the durable oversized head and an enlarged sweet spot offered by a metallic club. The adhesion enhancing channels 48 are shown at the sides of the insert cavity 18.

Referring to FIG. 5, the club head is shown in cross-section. The crown seam 24 is shown protruding from the interior surface of the crown 12. The hosel 16 is shown in FIG. 5. The shaft penetrates the hosel 16 through shaft bore 17. The hosel 16 extends into the club head to form hosel continuation 25. The hosel 16 continues through the heel end of the crown 12 and penetrates to a depth equal to the shaft penetration within the interior of the club head. The hosel continuation 25 separates and insulates the shaft from the packing material inside the club head 10. The hosel continuation 25 reduces vibrational energy from being transmitted from the club shaft to the packing material inside the club. The hosel continuation 25 also prevents the epoxy, glue or cement used to secure the club shaft into the hosel bore 17 from leaking into the club head and adversely reacting with the packing material inside the club head. Vibrational energy or epoxy leaking into the packing material may cause crystallization of the packing material. These crystallized components of the packing material may separate and cause a distracting rattle from inside the club head.

Figure 9:
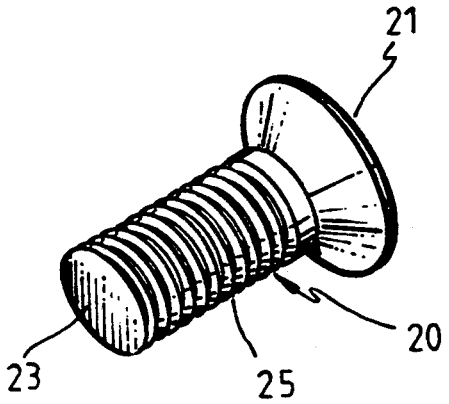
FIG. 9 is a detailed view of a hollow face pin.

The insert cavity 18 walls form a sunken box on the club face 28. The front or face edge of the crown 12 forms the top support wall 17 for the insert cavity 18. The front or face edge of the sole forms the lower support wall 15 for the insert cavity 18. In a preferred embodiment the upper wall 17 and the lower wall 15 and the insert cavity surface 13 of the insert cavity 18 are molded to a uniform thickness. The insert 19 fits within the insert cavity 18. In a preferred embodiment the hollow face pins 20 are molded into the insert 19. Alternatively, the hollow face pins 20 may fit within face pin holes 42. The face pins 20 are hollow so that an open ended cavity opening at the back of the insert formed by the internal hollow portion of the face pin 20 as shown in FIG. 5. The head of the pin is closed. In a preferred embodiment, the face pins extend substantially the entire width of the insert. The pin may be recessed slightly so that the pin does not contact the insert cavity face surface. The pin heads may resemble a screw head or a smooth rivet or other pattern. As shown in FIG. 9, the face pins 20 have a closed end or head 21 and an open end 23 which is hollow. The sides 25 of the pin may be knurled or grooved to enhance adhesion. The epoxy, glue or cement placed in the insert cavity 18 and into the hollow portion of face pin 20. In an alternative embodiment having pin holes 42 the epoxy, glue or cement flows into the pin holes 42 and into the hollow face pins 20. In still another alternative embodiment the face pins may be solid and may be variable length so that they are long enough to penetrate substantially the entire width of the insert, or may be shorter so that they are recessed away from the insert's rear surface and the insert cavity surface. This design enhances the flow of the epoxy into the insert 19 and into the hollow face pins 20 thus enhancing the adhesion of the insert to the insert cavity. The epoxy, glue or cement also flows into the channels 48 formed at the perimeter of the side walls 44 of the insert cavity 18. In a preferred embodiment, the insert cavity side walls 44 project perpendicularly from the club face wall 28. These side insert support walls 44 form a perpendicular support for the insert 19 and serve to support the face wall 28 when striking a bell. These insert cavity walls are a uniform thickness in a preferred embodiment. The side walls 44 are the same thickness as the insert cavity surface 13 of the insert cavity 18. The uniform thickness supports the insert evenly, enhances the sound and feel of the club head when striking a golf ball and facilitates heat treatment hardening of the club head by reducing the likelihood of cracking or deformation due to uneven contraction or expansion during the heat treatment process.

Figure 6:
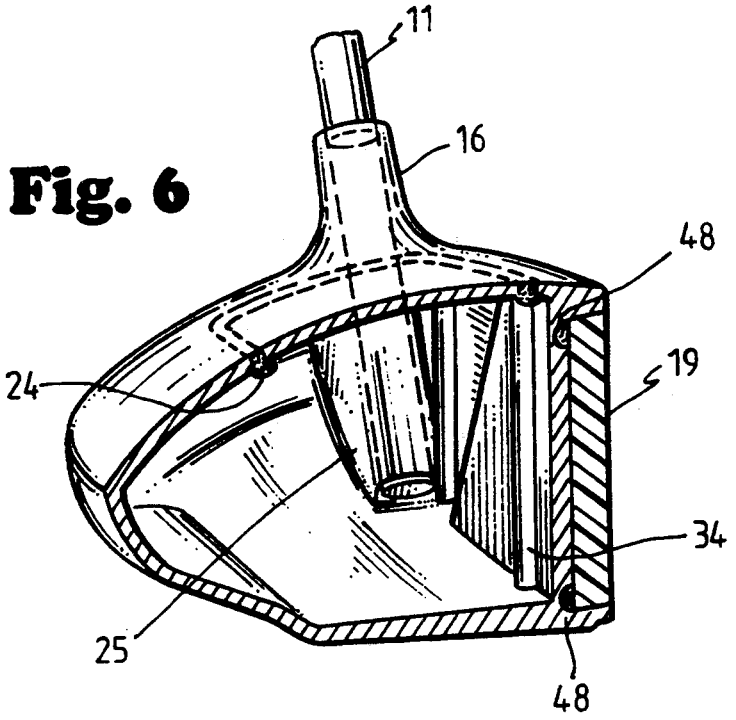
FIG. 6 is a front cross-sectional view taken along line 5—5 in FIG. 3 showing the extended hosel penetrating the interior of the club head with the insert placed in the insert cavity.

Referring now to FIG. 6, the insert 19 is secured to insert cavity 18. The hosel extension 25 is shown covering substantially all of the shaft 11 portion that penetrates the interior of the club head 10.

Figure 7A:
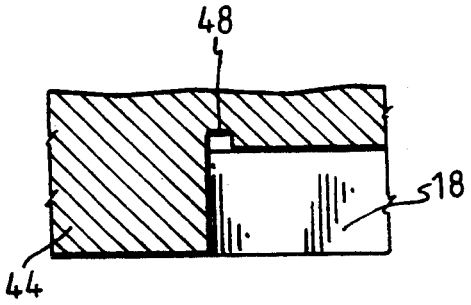
FIG. 7A is a cross-sectional view of the insert cavity showing a square channel.
Figure 7B:
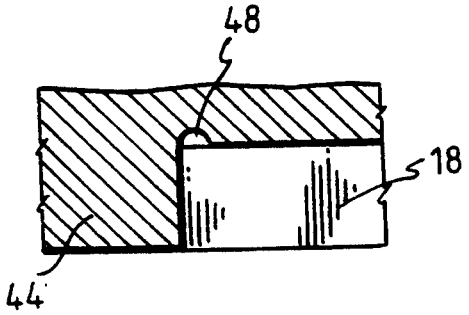
FIG. 7B is a cross-sectional view of the insert cavity showing a rounded channel.

Referring to FIG. 7A, a cross-sectional view of the insert cavity 18 in a preferred embodiment is shown with a square channel 48 formed at the perimeter or edge of the insert cavity 18 exterior face. The channels may be any shape but are round in a preferred embodiment. FIG. 7B shows a rounded channel 48 formed at the perimeter of the insert cavity 18.

Figure 8:
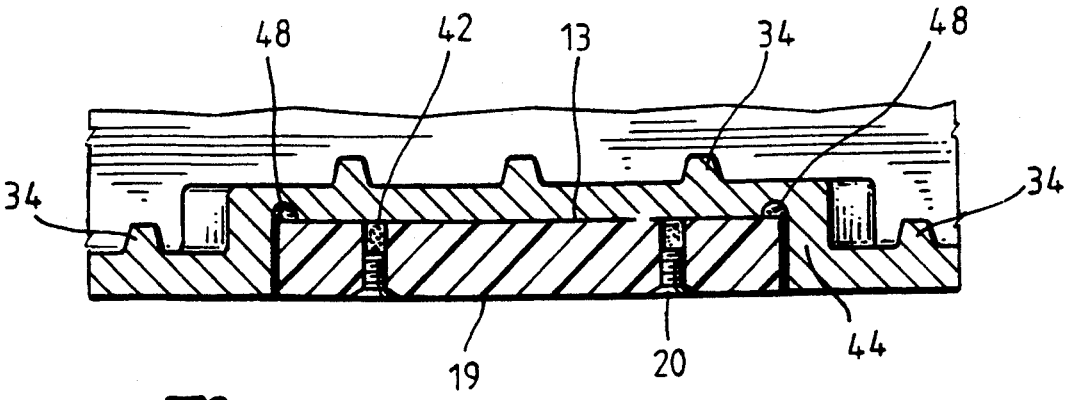
FIG. 8 is a cross-sectional view of the club head face showing the insert secured in the insert cavity.

Referring now to FIG. 8, a portion of the club face 28 is shown in cross section with the insert 19 secured to the insert cavity 18. In a preferred embodiment the hollow face pins penetrate substantially the entire thickness of the insert and thus permitting the interior of the pins to be filled or partially filled with epoxy. The face pins 20 may be any length however and may be shorter than the width of the insert. An alternative embodiment may utilize pin holes found in the insert and pins shorter than the thickness of the insert. In such an alternative embodiment the pins are shorter than the width of the insert and the pin holes 42 and the hollow pins 20 will receive excess epoxy or glue as the epoxy or glue is displaced by the insert and flows from the cavity. The hollow face pins 20 and pin holes 42 are filled with epoxy. The channels 48 are also shown filled with epoxy. The amount of epoxy filling the pin holes 42 and hollow pins 20 and thus the amount of air left in the face pins 20 and pin holes 42 may be varied and controlled by the amount of epoxy or adhesive placed in the insert cavity 18. If the hollow face pins 20 and pin holes 42 are partially filled with epoxy or adhesive, this will affect the sound and feel of the club as it hits a golf club. The amount of epoxy or adhesive in these cavities can be controlled by the amount of epoxy inserted into the insert cavity. The amount of epoxy in the channels 48 also affects the sound and feel of the club when striking a golf ball. The amount of the epoxy in the channels can be controlled by the amount of epoxy placed in the insert cavity 18. This amount of air left in the channels 48 face pins 20 and pin holes 42 also affects the flexibility of the insert and thus the sweet spot on the club face.

In a preferred embodiment the weight of the head is 195–205 grams. The distance from the face to the back of the head or the head width is 92.5 millimeters the radius of the face is 11", the volume of the head is 275 cubic centimeters, the height of the face is 49.5 millimeters, the length of the face is 95 millimeters, the cavity height is 44.5 millimeters, the cavity length at the top is 30 millimeters, and the cavity length at the bottom 47 millimeters. The angle formed by the semi-vertical cavity walls is 12° off vertical. The trace lines horizontally marked in the face of the club are the following dimensions; the top trace line length is 53 millimeters and the bottom trace line length is 33 millimeters. The distance between the top and the bottom trace line is 36 millimeters. The total number of trace lines or grooves in the face is nine. The depth of the cavity is 6 millimeters and the wall thickness of the face is 4 millimeters. The radius of curvature for the concave portion at the rear of the sole is 2" radius. The loft angle of the face of the club or the angle the face makes with a vertical line is 10.5°, the height of the crown or head is 52.5 millimeters, the loft angle is 10.5°, the head width is 92 millimeters, the sole width is 53 millimeters, the vertical trace radius is 12" radius.

The foregoing description is that of a preferred embodiment. It will be appreciated that modifications of the disclosed embodiment will suggest themselves to one skilled in the pertinent arts. Each modification should be considered within the spirit and scope of the invention, as defined in the claims.

I claim:

1. A hollow metal wood golf club head, comprising:
a ball striking face having upper and lower edges;
a sole plate joined to the lower edge of said ball striking face;
a crown joined to the upper edge of said ball striking face and defining an opening;
a crown plate configured to fit within said opening in said crown and seamed to the crown to fill the opening and reinforced the crown; and
said ball striking face, sole plate, crown and crown plate defining, in part, a hollow interior region adapted for receiving synthetic plastic foam material.

2. A metal wood golf club head as recited in claim 1, further comprising a lip extending along the edge of said opening to engage and support said crown plate.

3. A metal wood golf club head as recited in claim 1 which further comprises a weld bead for seaming the crown plate to the crown.

4. A metal wood golf club head, comprising:
a ball striking face having upper and lower edges;
a sole plate joined to the lower edge of said ball striking face;
a crown joined to the upper edge of said ball striking face and defining an opening;
a crown plate configured to fit within said opening in said crown, said crown plate and said crown defining a juncture therebetween;
a lip extending from said opening in said crown to engage and support said crown plate; and
a reinforcing weld bead formed at the juncture of said crown and said crown plate.

5. A golf club head comprising:
a metallic ball striking face having upper and lower edges;
a metallic sole plate, a portion of which is disposed adjacent said lower edge of said ball striking face;
a metallic crown, a portion of which is disposed adjacent said upper edge of said ball striking face said crown defining an opening;
a metallic crown plate configured to fit within said opening in said crown, said crown plate and said crown defining a juncture therebetween;
a lip extending from said opening in said crown to engage and support said crown plate;
a reinforcing weld bead formed at the juncture of said crown and said crown plate;

a walled cavity formed in said ball striking face;

a nonmetallic insert fitted within said cavity in said ball striking face; and means for securing said insert in said cavity.

6. A golf club head as recited in claim 5, wherein said means for securing said insert into said cavity comprises a plurality of pins disposed in said insert, said pins adapted for adhering to an adhesive bonding agent disposed between said insert and said cavity.

7. A golf club head as recited in claim 5, which further comprises a plurality of channels formed in said cavity walls adjacent said insert, and wherein said means for securing said insert comprises an adhesive bonding agent disposed within said channels between said insert and said cavity walls.

8. A method of making a metal wood golf club head which includes a ball striking face, a sole plate, a hosel, and a crown, comprising the steps of:

forming the ball striking face, sole plate, hosel, and crown in one piece with said crown defining an opening;

providing a crown plate configured to fill the opening;

positioning said crown plate within said opening; and welding said crown plate to said crown.

9. A golf club head comprising:

a metallic ball striking face having upper and lower edges;

a metallic sole plate joined to the lower edge of said ball striking face;

a metallic crown joined to the upper edge of said ball striking face and defining an opening;

a metallic crown plate configured to fit within said opening in said crown, said crown plate and said crown defining a juncture therebetween;

a lip extending from said opening in said crown to engage and support said crown plate;

a reinforcing weld bead formed at the juncture of said crown and said crown plate;

a walled cavity formed in said ball striking face; and a nonmetallic insert fitted within said cavity in said ball striking face.

10. A golf club as recited in claim 9, further comprising means for securing said insert in said cavity.

11. A golf club as recited in claim 10, wherein said means for securing said inset in said cavity comprises a plurality of pins disposed in said insert, said pins adapted for adhering to an adhesive bonding agent disposed between said cavity and said insert.

12. A golf club head as recited in claim 11, which further comprises a plurality of channels formed in said cavity walls adjacent said insert, said channels adapted to receive an adhesive bonding agent disposed between said insert and said cavity.

13. A golf club head as recited in claim 10, wherein said pins are hollow.

14. A golf club head as recited in claim 10, wherein said pins are solid.

15. A golf club head as recited in claim 14, wherein said pins have a roughened exterior surface.

16. A golf club head as recited in claim 10, wherein said pins have a roughened exterior surface.

17. A golf club head as recited in claim 16, wherein said pins are hollow.

18. A golf club head as recited in claim 16, wherein said pins are solid.

* * * * *